United States Patent [19]

Snyder

[11] 4,429,419

[45] Feb. 7, 1984

[54] SAFETY GARMENT

[76] Inventor: Robert Z. Snyder, 1141 Harriett Rd., Huntingdon Valley, Pa. 19006

[21] Appl. No.: 339,620

[22] Filed: Jan. 15, 1982

[51] Int. Cl.[3] ..... A41D 1/04; A41F 9/00; A41F 19/00

[52] U.S. Cl. ..... 2/102; 2/311; 2/305

[58] Field of Search ..... 2/305, 102, 2, 311

[56] References Cited

U.S. PATENT DOCUMENTS

| | | | |
|---|---|---|---|
| 811,167 | 1/1906 | Paddock . | |
| 970,824 | 9/1910 | Hoppenstein . | |
| 1,475,072 | 11/1923 | Langerman . | |
| 1,486,676 | 3/1924 | Nilssen . | |
| 2,162,948 | 6/1939 | Gosselin . | |
| 2,229,593 | 1/1941 | Knight . | |
| 2,908,324 | 10/1959 | Muller et al. . | |
| 3,004,519 | 10/1961 | Weissman | 2/102 |
| 3,487,474 | 1/1970 | DeMeo . | |
| 3,529,307 | 9/1970 | Belson et al. . | |
| 3,533,107 | 10/1970 | Raneri et al. . | |
| 3,562,812 | 2/1971 | Greggains . | |
| 3,564,616 | 2/1971 | Battaglia . | |
| 4,028,742 | 6/1977 | Marquis | 2/305 |
| 4,059,852 | 11/1977 | Crane | 2/2 |
| 4,172,292 | 10/1979 | Horton . | |

*Primary Examiner*—Doris L. Troutman
*Attorney, Agent, or Firm*—Morton J. Rosenberg

[57] ABSTRACT

A safety garment (10) which is adapted to be worn by a vehicle driver (12) and to be held or grasped by a passenger (16) seated behind the driver (12). Safety garment (10) includes a vest member (18) which is worn by the vehicle driver (12) and substantially encompasses the torso of the driver (12). First and second belt members (32 and 34) encircle the vest member (18) throughout an external surface thereof. The first and second belt members (32 and 34) are vertically displaced each from the other, and encircle the driver (12) in a substantially parallel manner. Hand grip straps (46 and 48) are coupled to the first and second belt members (32 and 34) to provide a hand grip for the passenger (16) located to the rear of the vehicle driver (12).

15 Claims, 3 Drawing Figures

SAFETY GARMENT

BACKGROUND OF THE INVENTION

1. Field of the Invention

This invention pertains to a safety garment for use by a driver of a vehicle. More in particular, this invention relates to a safety garment which is to be grasped by a passenger located to the rear of the driver of the vehicle. Further, this invention pertains to a safety garment which includes first and second belt members encircling the driver and releasably coupled to a vest member worn by the vehicle driver. More in particular, this invention relates to a pair of vertically directed hand grips releasably coupled to first and second belt members encircling a driver. Still further, this invention pertains to a vehicle securement mechanism whereby the driver is coupled to the frame of the vehicle.

2. Prior Art

Safety garments adapted to be worn by a driver of a vehicle are well-known in the art. The best prior art known to the Applicant includes the following U.S. Pat. Nos. 4,172,292; 3,533,107; 3,562,812; 4,059,852; 4,028,742; 3,564,616; 2,162,948; 2,229,593; 1,475,072; 2,908,324; 3,004,519; 1,486,676; 3,529,307; 3,487,474; 811,167; and, 970,824.

Reference U.S. Pat. No. 4,172,292 does provide for a vest-like garment which has handholds for holding into a wearer. However, such prior art systems do not provide for grasping straps on the back of the vest being coupled to a pair of encircling belt members. It is not believed that such prior art systems provide for the load bearing capability as that provided by the subject invention concept.

U.S. Pat. No. 3,533,107 directs itself to prior art safety garments for cyclists. However, such prior art system does not show the hand grips mounted on the back of the vest-like garment which are transversely adjustable. Additionally, the subject invention system allows for the load bearing to be distributed between a pair of vertically displaced strap members, not shown in this type of prior art system.

Reference U.S. Pat. No. 3,562,812 also directs itself to a safety handhold for tandem riders. However, the hand grips as provided in this type of prior art reference, are mounted around the front of the rider which is disadvantageous due to the fact that when a force is applied, the force loading is maintained over a smaller area than that provided in the subject invention system and thus, creates high stresses.

Other prior art systems such as that provided in U.S. Pat. No. 4,059,852 does provide for a fastening mechanism to couple the driver to a motorcycle. However, such does not provide for the coupling mechanisms to be mounted on the belt members encircling the torso of the driver, as is provided in the subject invention concept and causes a distribution of load which is advantageous.

SUMMARY OF THE INVENTION

A safety garment adapted to be worn by a driver of a vehicle. The safety garment includes a vest member substantially encompassing the torso of the driver. First and second belt members encircle the vest member with the second belt member being vertically displaced from the first belt member. Additionally, the safety garment includes hand grip mechanisms coupled to the first and second belt members for providing a hand grip for a passenger located to the rear of the driver.

DESCRIPTION OF THE PREFERRED EMBODIMENTS

Figure 1:
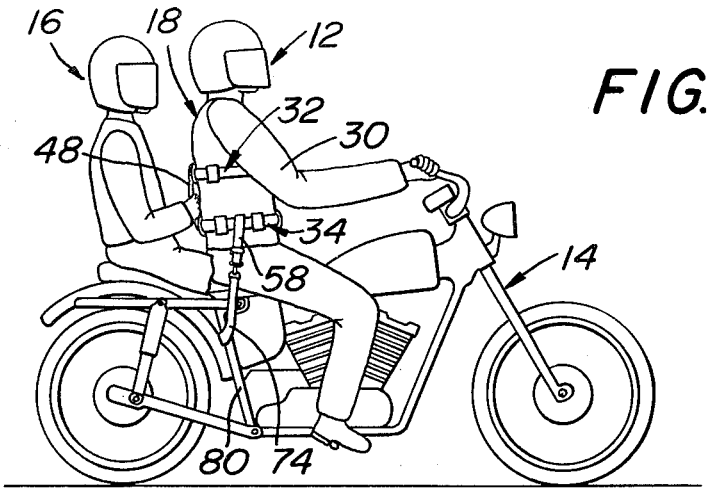
FIG. 1 is a side view of the safety garment being worn by the driver of a vehicle with a passenger in tandem.
Figure 2:
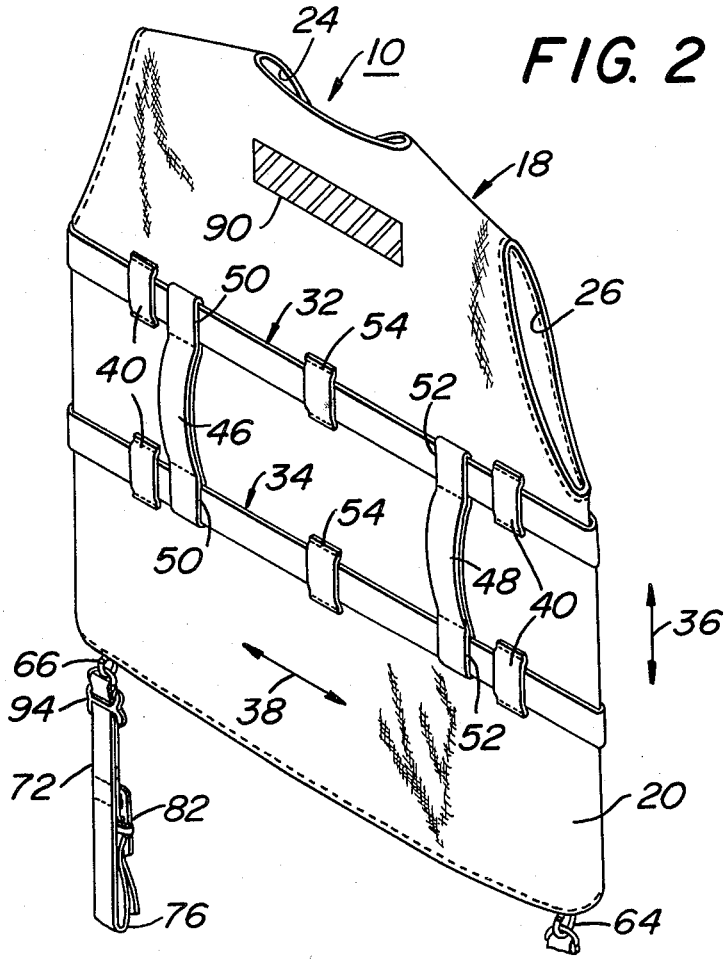
FIG. 2 is a rear perspective view of the safety garment.
Figure 3:
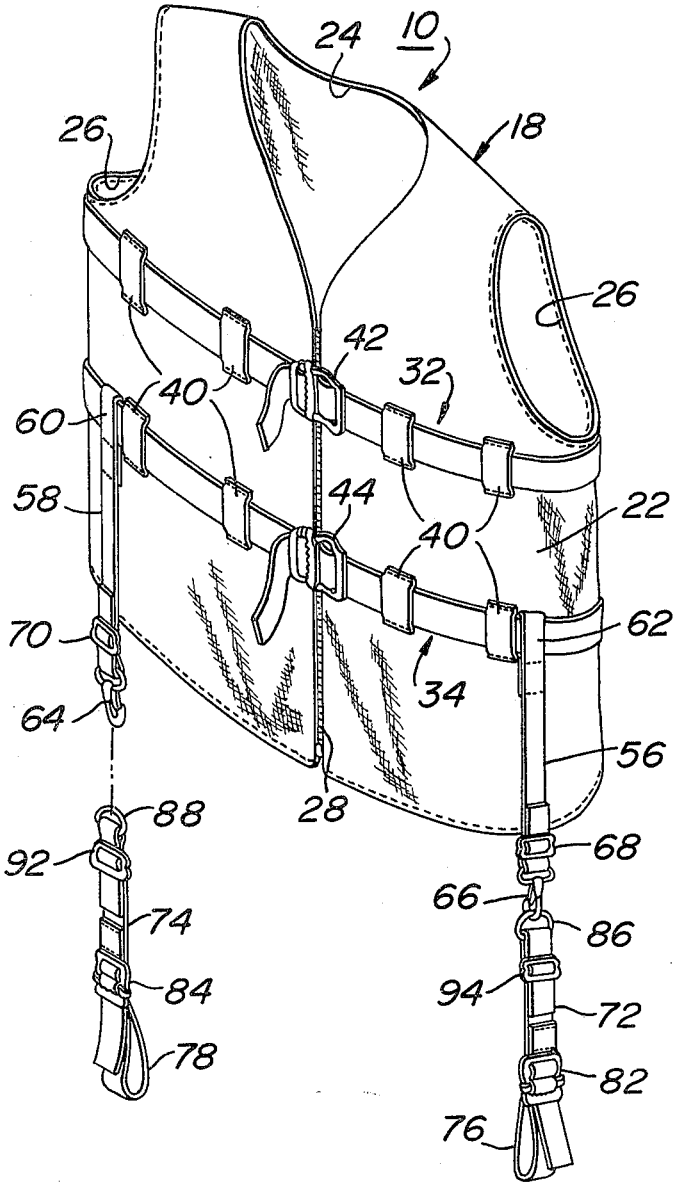
FIG. 3 is a frontal perspective view of the safety garment.

Referring now to FIGS. 1–3, there is shown safety garment 10 adapted to be worn by driver 12 of vehicle 14 which may be a motorcycle or some like conveying device. In overall concept, as will be detailed in following paragraphs, safety garment 10 is provided for a multiplicity of purposes and objectives. Of primary importance, safety garment 10 provides a grip for passenger 16 when passenger 16 is seated behind vehicle driver 12 on vehicle 14. Thus, in the event of sudden stops or high acceleration or deceleration, passenger 16 will not be thrown from vehicle 14, but may hold on to vehicle driver 12. Safety garment 10 thus provides passenger 16 with a positive grip on driver 12 when inertia forces would tend to throw passenger 16 from vehicle 14.

Additionally, safety garment 10 provides for a constraining device to releasably couple vehicle driver 12 to vehicle 14. Thus, under high acceleration, deceleration, or other forces which would tend to displace vehicle driver 12 from vehicle 14, safety garment 10 provides for a maintenance of driver 12 on vehicle 14. Still further, safety garment 10 may further provide visual indication of driver 12 during low light intensity times. Further, safety garment 10 may be worn by driver 12 to provide protection against the elements during use.

Safety garment 10 includes vest member 18 as is clearly seen in FIGS. 2 and 3. As is shown in FIG. 1, vest member 18 is adapted to substantially encompass the torso of vehicle driver 12. Vest member 18 includes rear portion 20 and frontal portion 22 and includes neck opening 24, as well as transversely displaced arm openings 26. Thus, vest member 18 may be worn in the normal fashion of a jacket.

Vest member 18 includes zipper closure mechanism 28 as shown in FIG. 3, for releasably securing vest member 18 to the torso of vehicle driver 12. Thus, driver 12 inserts his or her arms 30 through arm openings 26 of vest member 18, and then actuates zipper closure mechanism 28 to releasably secure vest member 18 to the torso of driver 12.

Vest member 18 may be formed of a textile material, synthetic material, or some like flexible composition. Additionally, vest member 18 may be formed of a mesh type material formed of a natural or synthetic composition with the load bearing strength of the particular material used in vest member 18 not being overly important due to the fact that any force loading is generally not taken up or applied to vest member 18 directly, as will be seen in following paragraphs.

Safety garment 10 includes first and second belt members 32 and 34, respectively. First belt member 32 encircles vest member 18 as is shown in FIGS. 2 and 3. Additionally, second belt member 34 encircles vest member 18 with second belt member 34 being displaced from first belt member 32 in vertical direction 36 throughout their enclosing contour. First and second belt members 32 and and 34 are generally directed parallel each to the other and pass in transverse direction 38 around the external surfaces of rear vest portion 20 and frontal vest portion 22.

First and second belt members 32 and 34 are constrained from displacement in vertical direction 36 through a vertical constraining mechanism comprising a plurality of belt loop members 40 fixedly secured to rear and frontal vest portions 20 and 22 of vest member 18. First and second belt members 32 and 34 pass through at least one of belt loop members 40, as is shown in FIGS. 1–3. Belt loop members 40 may be formed of a natural or synthetic textile material and may be fixedly secured to vest member 18 through sewing or some like fixed securement means. Additionally, belt loop members 40 must provide an opening passage for first and second belt members 32 and 34, in order that such members may be transversely displaced in direction 38 in a reversible manner. Thus, first and second belt members 32 and 34 slide within the openings provided by belt loop members 40.

Safety garment 10 further includes a mechanism for releasably coupling first and second belt members 32 and 34 to vest member 18. The releasable coupling mechanism includes first and second buckle members 42 and 44 secured respectively to first belt member 32 and second belt member 34, as is clearly seen in FIG. 3. The particular buckle mechanism or releasable coupling system is not important to the inventive concept as is herein described, with the exception that an appropriate pair of buckle members 42 and 44 are used which allows for coupling and release at the option of the wearer, or vehicle driver 12.

Both first and second belt members 32 and 34 may be formed of leather, nylon, or some similar type of flexible material composition, not important to the inventive concept as is herein described with the exception that the material composition of first and second belt members 32 and 34 must be formed of a material sufficient to maintain its integrity responsive to various inertia forces, as hereinbefore described.

Safety garment 10 further includes hand grip strap members 46 and 48 coupled to first and second belt members 32 and 34 for providing a hand grip for passenger 16 located to the rear of vehicle driver 12, as shown in FIG. 1. As is shown in FIG. 2, hand grip strap members 46 and 48 extend generally in vertical direction 36 and are secured to first and second belt members 32 and 34 on opposing ends thereof. Each of hand grip strip members 46 and 48 include loop sections 50 and 52, which pass around respective first and second belt members 32 and 34. Loop sections 50 and 52 of strap members 46 and 48 allow for reversible displacement of first and second belt members 32 and 34 in transverse direction 38. In this manner, hand grip strap members 46 and 48 are adjustable in transverse direction 38 for the comfort and accessability of passenger 16. Hand grip strap members 46 and 48 may be formed of substantially the same material as that provided for first and second belt members 32 and 34. Additionally, the combination of hand grip strap members 46 and 48 and first and second belt members 32 and 34 should at least provide for a bearing force of three hundred pounds. Thus, hand grip strap members 46 and 48 may be formed of leather, nylon, or textile material sufficiently strong to withstand force loading as previously described, and should be flexible in nature to provide an easy hand grip for passenger 16.

Both hand grip strap members 46 and 48 have been stated to be slidably displaceable in transverse direction 38 on first and second belt members 32 and 34. As can be seen, rear vest portion 20 of vest member 18 includes central belt loop members 54 which are mounted over first and second belt members 32 and 34. Thus, each of hand grip strap members 46 and 48, although being transversely displaceable on first and second belt members 32 and 34, are captured between central belt loop members 54 and external or transversely displaced belt loop members 40. This capturing of hand grip strap members 46 and 48 provides for adjustability, but maintenance of strap members 46 and 48 to the rear vest portion 20.

Safety garment 10 further includes a securement mechanism for securing driver 12 to vehicle 14. The securing mechanism, as will be described in following paragraphs, is coupled on opposing ends thereof to second belt member 34 and vehcle 14, respectively.

The driver securement mechanism includes belt securement strap members 56 and 58 shown in FIG. 3. Each of belt securement strap members 56 and 58 have formed belt loops 62 and 60 on one end for passage therethrough of second belt member 34, as is seen in FIG. 3. Additionally, each of belt securement strap members 56 and 58 have associated snap fasteners 66 and 64 on opposing ends thereof. Snap fasteners 64 and 66 are of the conventional type which provides for a releasable hook member. Additionally, each of belt securement strap members 56 and 58 have associated therewith adjustable buckle members 68 and 70 to allow for vertical adjustability of securement strap members 56 and 58.

Additionally, the securing mechanism further includes vehicle securement straps 72 and 74 having loop portions 76 and 78 shown in FIG. 3. Loop sections or portions 76 and 78 are placed around a frame portion of vehicle 14 such as arm member 80 of vehicle 14, shown in FIG. 1. Each of vehicle securing straps 72 and 74 further include adjustable securing buckles 82 and 84, respectively, for adjusting the loops 76 and 78 for securing buckles 82 and 84 around a frame portion of vehicle 14 such as arm member 80, as shown in FIG. 1. Adjustable buckles 94 and 92 allow adjustability of the overall length of associated securing straps 72 and 74. Additionally, each of vehicle securing straps 72 and 74 include ring members 86 and 88 to allow releasable coupling to snap fasteners 66 and 64, as is shown.

In this manner, vehicle securing straps 72 and 74 may be coupled to an arm member 80 of vehicle 14, and remain coupled thereto for prolonged periods of time. Whenever driver 12 wishes to dismount or otherwise leave vehicle 14, snap fasteners 66 and 64 may be disengaged from respective ring members 86 and 88. Thus, belt securement strap members 56 and 58 need not be removed from second belt member 34 when driver 12 wishes to remove himself or herself from vehicle 14.

Thus, when belt securement strap members 56 and 58 are coupled through respective vehicle securing straps 72 and 74 and such straps are secured to a frame member of vehicle 14, driver 12 is constrained to vehicle 14. In this manner, when inertia forces are applied, driver 12 will remain relatively constrained to vehicle 14 and will not be thrown from vehicle 14.

Vehicle securing straps 72 and 74 and associated adjustable securing strap members 56 and 58 may be formed of substantially the same material composition as that previously described for first and second belt members 32 and 34. Thus, such members may be formed of a nylon, leather, or other flexible material which can withstand the loading of high acceleration or deceleration forces.

Safety garment 10 further may include visual coating mechanism 90 secured to vest member 18 on rear vest portion 20, as is shown in FIG. 2. Visual coating 90 may consist of a luminescent coating layer applied to a predetermined portion of an external surface of vest member 18, or may simply consist of a reflective coating well-known in the art. In this manner, vehicle driver 12 may clearly be seen during low light conditions in the absence of passenger 16 blocking such view of rear oncoming vehicles.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A safety garment adapted to be worn by a driver of a vehicle, comprising:

(a) a vest member substantially encompassing the torso of said driver;

(b) a first belt member encircling said vest member;

(c) a second belt member encircling said vest member, said second belt member being vertically displaced from said first belt member;

(d) hand grip means coupled to said first and second belt members for providing a hand grip for a passenger located to the rear of said driver; and, (e) means for vertically constraining displacement of said first and second belt members on said vest member, said vertical constraining means including a plurality of belt loop members fixedly secured to said vest member, each of said first and second belt members passing through at least one of said belt loop members.

2. The safety garment as recited in claim 1 including means for releasably coupling said first and second belt members to said vest member.

3. The safety garment as recited in claim 2 where said releasable coupling means includes a first and second buckle member secured to said first belt member and said second belt member.

4. The safety garment as recited in claim 1 where said hand grip means includes at least one hand grip strap member extending in said vertical direction and secured to said first and second belt members on opposing ends thereof.

5. The safety garment as recited in claim 4 where said hand grip means includes a pair of vertically extending hand grip strap members secured to said first and second belt members.

6. The safety garment as recited in claim 5 where each of said hand grip strap members is reversibly displaceable in a transverse direction on said first and second belt members.

7. The safety garment as recited in claim 6 where each of said hand grip members includes a pair of hand grip strap loop members formed on opposing ends thereof for insert therethrough of said first and second belt members.

8. The safety garment as recited in claim 1 including means for securing said driver to said vehicle, said securing means being coupled on opposing ends thereof to said second belt member and said vehicle respectively.

9. The safety garment as recited in claim 8 where said driver securement means includes:

(a) at least belt securement strap member forming a loop on one end for passage therethrough of said second belt member, and a releasable hook member on an opposing end; and, (b) at least one vehicle securement strap member forming a loop on one end for coupling to said vehicle and a ring member on an opposing end for coupling to said releasable hook member.

10. The safety garment as recited in claim 1 including means for releasably securing said vest member to said torso of said driver, said vest securement means including a zipper closure member.

11. The safety garment as recited in claim 1 where said vest member is formed of a textile material.

12. The safety garment as recited in claim 11 where said vest member is formed of a mesh textile material.

13. The safety garment as recited in claim 1 including visual coating means secured to said vest member for increasing visibility of said driver during low light conditions.

14. The safety garment as recited in claim 13 where said visual coating means includes a luminescent coating layer applied to predetermined portions of an external surface of said vest member.

15. The safety garment as recited in claim 13 where said visual coating means includes a light reflective member secured to an external surface of said vest member.

* * * * *